US009890619B2

(12) United States Patent
Shahinpour et al.

(10) Patent No.: US 9,890,619 B2
(45) Date of Patent: Feb. 13, 2018

(54) BALLISTIC TRANSFER MODULE

(71) Applicant: DynaEnergetics GmbH & Co. KG, Troisdorf (DE)

(72) Inventors: Arash Shahinpour, Troisdorf (DE); Jörg Müller, Bonn-Lengsdorf (DE); Eric Mulhern, Edmonton (CA); Frank Haron Preiss, Bonn (DE)

(73) Assignee: DynaEnergetics GmbH & Co.KG, Troisdorf (DE)

( * ) Notice: Subject to any disclaimer, the term of this patent is extended or adjusted under 35 U.S.C. 154(b) by 0 days.

(21) Appl. No.: 14/911,351

(22) PCT Filed: Jul. 22, 2014

(86) PCT No.: PCT/EP2014/065754
§ 371 (c)(1),
(2) Date: Feb. 10, 2016

(87) PCT Pub. No.: WO2015/028205
PCT Pub. Date: Mar. 5, 2015

(65) Prior Publication Data

US 2016/0202033 A1 Jul. 14, 2016

(30) Foreign Application Priority Data

Aug. 26, 2013 (DE) ..... 10 2013 109 228

(51) Int. Cl.
*F42D 1/04* (2006.01)
*E21B 43/1185* (2006.01)
*E21B 43/11* (2006.01)

(52) U.S. Cl.
CPC ..... *E21B 43/1185* (2013.01); *E21B 43/11* (2013.01); *F42D 1/043* (2013.01)

(58) Field of Classification Search
CPC .... C06C 5/04; C06C 5/06; C06C 5/00; C06C 7/00; F42C 19/00; F42C 19/02; F42C 19/08; F42C 19/10; F42D 1/043
(Continued)

(56) References Cited

U.S. PATENT DOCUMENTS 2,666,388 A * 1/1954 Wheeler ..... F42C 15/188 102/254
2,876,701 A * 3/1959 Long ..... E21B 43/11855 102/272

(Continued)

FOREIGN PATENT DOCUMENTS

CN 201011301 Y 1/2008
CN 101691837 A 4/2010

(Continued)

OTHER PUBLICATIONS

Owen Oil Tools, HTD-Blast System (Horizontal Time Delay Ballistic Assisted Sequential Transfer), Product Description Sheet TC-044-0.3, Revised May 2012.

(Continued)

*Primary Examiner* — Jonathan C Weber
(74) *Attorney, Agent, or Firm* — Lisa J. Moyles; Janelle A. Bailey

(57) ABSTRACT

According to an aspect a deformable member is provided, wherein the deformable member is configured for use in a ballistic transfer module. The ballistic transfer module includes the deformable member, a booster holder, a booster and a detonating cord. A method of initiating one or more percussion initiators of a perforating gun assembly using the ballistic transfer module and deforming the deformable member is also provided.

16 Claims, 5 Drawing Sheets

(58) Field of Classification Search
USPC ..... 102/275.11, 275.12, 275.4, 275.5, 275.6, 102/204, 275.9
See application file for complete search history.

(56) References Cited

U.S. PATENT DOCUMENTS 3,106,892 A * 10/1963 Miller ..... C06C 5/06 102/275.5
3,391,817 A * 7/1968 Shaw ..... B64D 37/005 220/246
3,610,151 A * 10/1971 Nett ..... F02K 9/95 102/204
3,678,853 A * 7/1972 Kilmer ..... F42B 3/10 102/275.4
3,945,322 A * 3/1976 Carlson ..... F42D 1/04 102/275.4
4,335,652 A * 6/1982 Bryan ..... F42B 3/16 102/202.1
4,612,992 A 9/1986 Vann et al.
5,031,538 A * 7/1991 Dufrane ..... C06C 5/06 102/275.11
5,162,606 A 11/1992 Jacob
5,182,417 A * 1/1993 Rontey ..... C06C 5/06 102/202.13
5,223,665 A 6/1993 Burleson et al.
5,327,835 A * 7/1994 Adams ..... F42D 1/043 102/275.11
5,417,162 A * 5/1995 Adams ..... F42D 1/043 102/275.11
5,490,563 A 2/1996 Wesson et al.
5,680,905 A 10/1997 Green et al.
5,775,426 A 7/1998 Snider et al.
5,780,764 A 7/1998 Welch et al.
5,889,228 A * 3/1999 Ewick ..... C06C 7/00 102/202.5
6,085,843 A 7/2000 Edwards et al.
6,408,759 B1 * 6/2002 Ewick ..... C06C 7/00 102/202.5
6,719,061 B2 4/2004 Muller et al.
7,044,236 B2 5/2006 Iversen et al.
7,913,603 B2 3/2011 LeGrange et al.
8,079,296 B2 12/2011 Barton et al.
8,622,149 B2 1/2014 Gill et al.
2002/0125045 A1 9/2002 George

FOREIGN PATENT DOCUMENTS

CN 201517410 U 6/2010
DE 102005058356.3 A1 6/2007
FR 1552100 A 1/1969

OTHER PUBLICATIONS

PCT Search Report and Written Opinion, dated May 4, 2015: See Search Report and Written opinion for PCT Application No. PCT/EP2014/065754.
DE Patent Office, Office Action dated May 26, 2014, in German, for DE Patent Application No. 10 2013 109 228.4, in the same family as PCT Application No. PCT/EP2014/065754.
SIPO, Search Report for CN App. No. 201480047088.0, which is in the same family as PCT App. No. PCT/EP2014/065754, dated Jun. 2, 2017, 3 pages.
SIPO, Office Action for CN App. No. 201480047088.0, which is in the same family as PCT App. No. PCT/EP2014/065754, dated Jun. 2, 2017, 7 pages.

* cited by examiner

BALLISTIC TRANSFER MODULE

CROSS-REFERENCE TO RELATED APPLICATIONS

This application claims priority to PCT Application No. PCT/EP2014/065754, filed Jul. 22, 2014, which claims priority to German Patent Application No. 102013109228.4, filed Aug. 26, 2013, each of which are incorporated herein by reference in their entirety.

FIELD

Devices and methods for initiating percussion of a perforating gun assembly are generally described. In particular, devices and methods for a ballistic transfer module are provided.

BACKGROUND

Hydrocarbons, such as fossil fuels (e.g. oil) and natural gas, are extracted from underground wellbores extending deeply below the surface using complex machinery and explosive devices. Once the wellbore is established by placement of cases after drilling, a perforating gun assembly, or train or string of multiple perforating gun assemblies, are lowered into the wellbore, and positioned adjacent one or more hydrocarbon reservoirs in underground formations. With reference to FIG. 1, a typical perforating gun assembly 40, (shown herein as a tubing conveyed perforating gun commercially available from DYNAenergetics GmbH & Co. KG), is depicted in which explosive/perforating charges 46, typically shaped, hollow or projectile charges, may be ignited to create holes in the casing and to blast through the formation so that the hydrocarbons can flow through the casing. As shown in the embodiment of FIG. 1, the perforating gun assembly 40 includes a gun casing or carrier or housing 48, within which various components are connected, ("connected" means screwed, abutted, snap-fit and/or otherwise assembled). At one end of the perforating gun assembly 40 of FIG. 1, a firing head 41 houses a piston 42 and a percussion initiator 10. The firing head 41 is connected to a top sub 45, and the top sub 45 houses a booster 43 and a detonating cord 44. The top sub 45 is connected to the gun housing 48, which houses an inner charge tube, strip or carrying device 47, which houses one or more of the charges 46. The detonating cord 44 makes a connection with each of the charge(s) 46. Between the firing head 41 and a tandem sub, one or multiple time delay subs may be positioned.

Once the perforating gun(s) is properly positioned, the piston 42 is accelerated by hydraulic pressure or mechanical impact, which in turn initiates the percussion initiator 10, which initiates the booster 43 to initiate the detonating cord 44, which detonates the shaped charges 46 to penetrate/perforate the casing and thereby allow formation fluids to flow through the perforations thus formed and into a production string.

In another assembly of the prior art as shown in FIG. 2, the firing head 41 that is preferably used between perforating gun assemblies and connected using a detonating cord and booster (as shown, for instance in FIG. 1), houses an alignment insert 4 on one end to which a firing pin housing 3 is connected. The firing pin housing 3 houses a firing pin 2 and is connected to an igniter support 6, which in turn houses an igniter or energetic material 5. In this assembly, initiation of the booster (not shown in FIG. 2) is used to accelerate the firing pin 2, which in turn initiates the igniter 5, which will either initiate the booster to initiate the detonating cord which detonates shaped charges in an adjacent gun or will initiate a time delay which activates one perforating gun assembly in the string of connected guns.

Advances in the art of initiating percussion initiators, particularly useful between a first perforating gun assembly and an adjacent perforating gun assembly (or multiples thereof) are constantly sought. In particular, assemblies according to the ballistic transfer module described herein improve percussion initiation, which results in improved reliability while decreasing complexity of the system, as well as lowering the cost to manufacture and assemble the perforating gun assemblies.

BRIEF DESCRIPTION

An embodiment provides a deformable member configured for use in a ballistic transfer module.

Another embodiment provides a ballistic transfer module including a deformable member, a booster holder, a booster and a detonating cord according to claim 1.

Another embodiment provides a method of initiating at least one percussion initiator of the perforating gun assembly using the ballistic transfer module and by deforming the deformable member according to the independent method claim.

BRIEF DESCRIPTION OF THE FIGURES

A more particular description briefly described above will be rendered by reference to specific embodiments thereof that are illustrated in the appended drawings. Understanding that these drawings depict only typical embodiments and are not therefore to be considered to be limiting of its scope, exemplary embodiments will be described and explained with additional specificity and detail through the use of the accompanying drawings in which.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to embodiments.

DETAILED DESCRIPTION

Reference will now be made in detail to embodiments. Each example is provided by way of explanation, and is not meant as a limitation and does not constitute a definition of all possible embodiments.

In an embodiment, a ballistic transfer module is provided that is capable of being placed into operation as part of a perforating gun assembly or string. The ballistic transfer module includes, as part of the assembly, a deformable member, as will be discussed in greater detail below. A method of using the ballistic transfer module to initiate percussion initiators in the perforating gun assembly, preferably between a first perforating gun assembly and adjacent perforating gun assembly, is also described.

Figure 1:
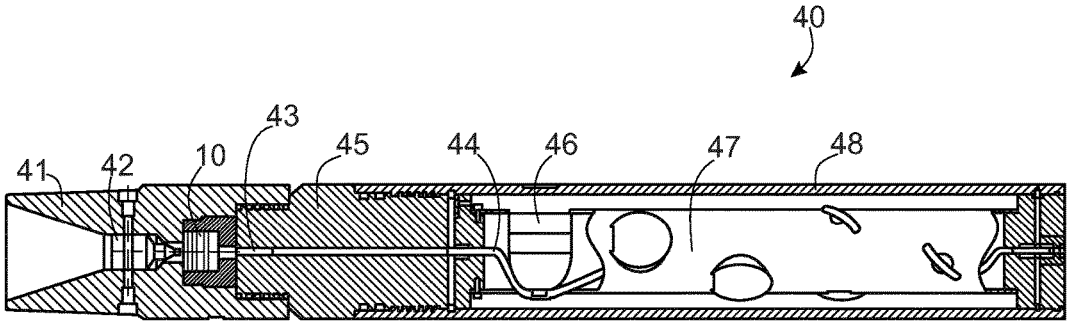
FIG. 1 (PRIOR ART)
FIG. 1 is a partial cross-sectional side view of a perforating gun assembly according to the prior art.
Figure 2:
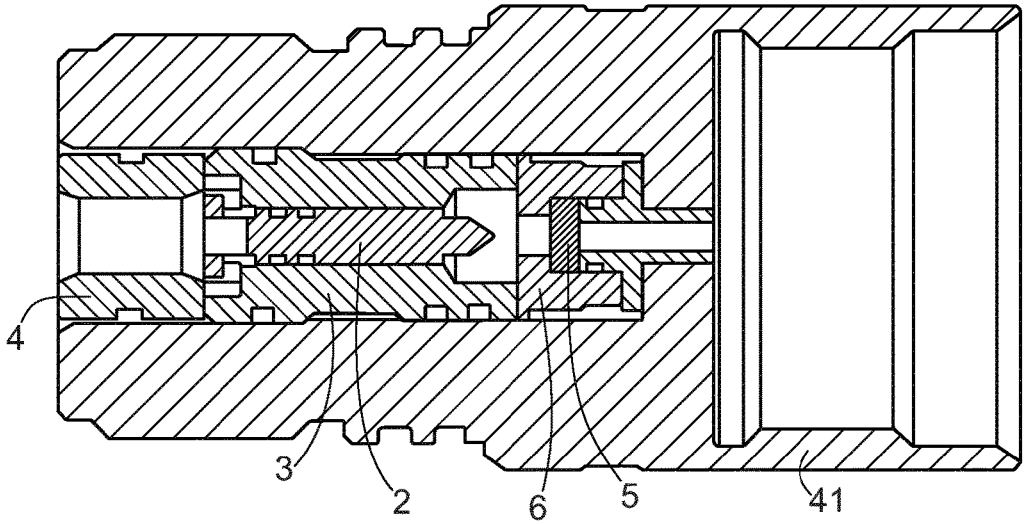
FIG. 2 (PRIOR ART)
FIG. 2 is a cross-sectional side view of a firing head according to the prior art.
Figure 3:
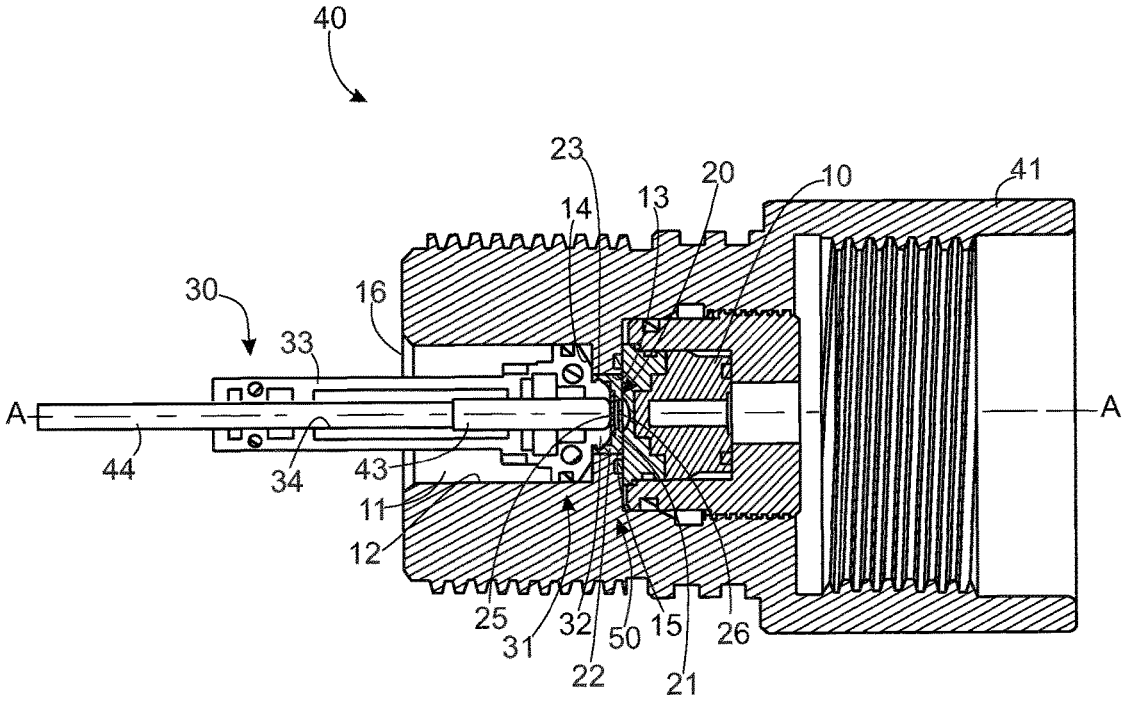
FIG. 3 is a cross-sectional side view of a ballistic transfer module and assembly according to an aspect.
Figure 4:
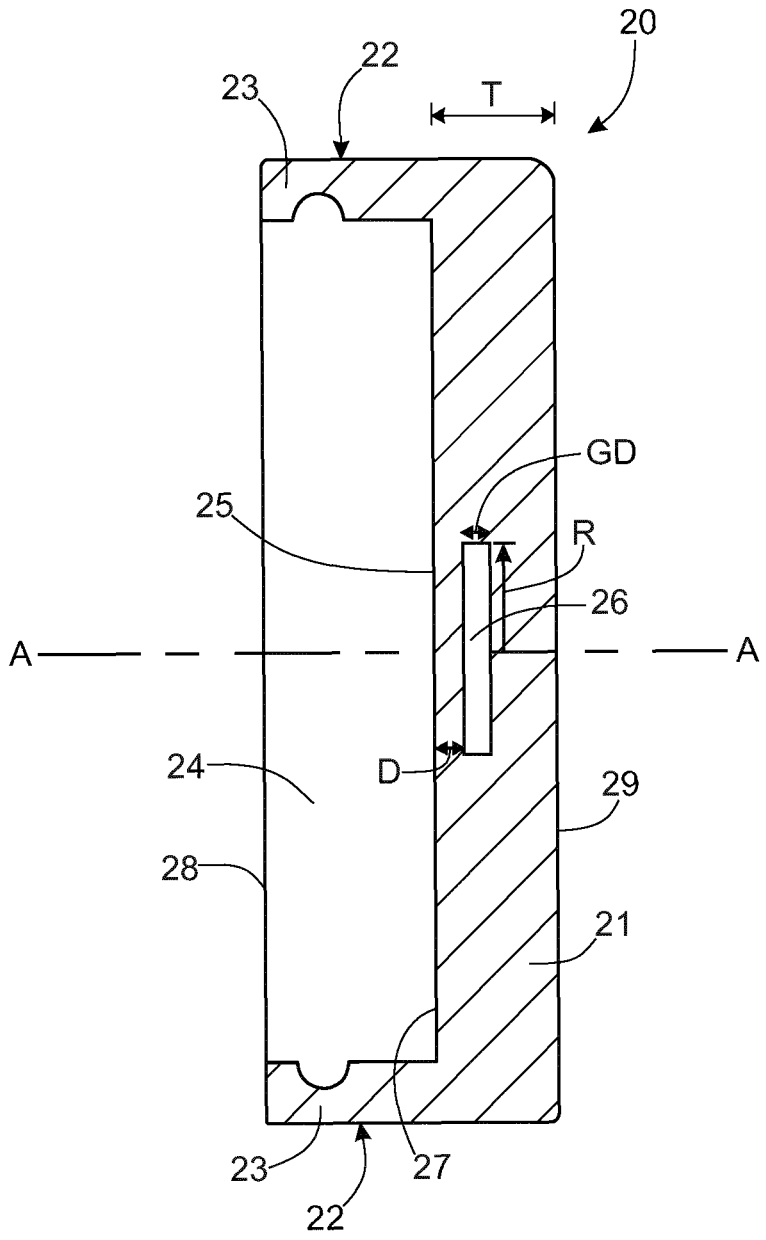
FIG. 4 is a cross-sectional side view a deformable member useful in the ballistic transfer module of FIG. 3, according to an aspect.

According to an aspect and with particular reference to FIG. 4, a deformable member 20 is depicted. The deformable member 20 is configured for placement in abutting contact with a percussion initiator 10, (see FIGS. 3 and 5), such that when the deformable member 20 deforms, it initiates the percussion initiator 10 as discussed in greater detail below. Thus, deformation of the deformable member 20 replaces movement of the firing pin 2 of the prior art as discussed above. The deformable member 20 includes a body 21, the body 21 having an inner surface 27 and an outer surface 29. The body 21, according to an aspect, may be configured as a solid (not shown) cylindrical-shape, (although other shapes are contemplated, like block-shaped—not shown), having a thickness T of about 1 mm to about 3 mm. In an embodiment, the body 21 is made of any material that is capable of being deformed (distort the shape or form of) without breaking, preferably any metallic material, composite material, or a combination of materials.

In an embodiment, the body 21 may include a gap 26, meaning the body 21 is a semi-solid body. The gap 26 is positioned within the body 21, and in an embodiment, the gap 26 is bound by walls forming a cylindrically-shaped opening and is centrally positioned along an axis A, such as a centralized axis, at a depth D of about 0.4 mm to about 0.6 mm below the inner surface 27 of the body 21. In an embodiment, a gap depth GD of the gap 26 is about 0.4 mm to about 0.6 mm, and has a radius R of about 3 mm to about 7 mm.

In an embodiment, a flange or collar or sleeve or wall 22 extends from the body 21 of the deformable member 20, and a retaining member 23 extends or depends from the collar 22. As depicted herein, the collar 22 surrounds a collar orifice 24, the orifice 24 being open on one end at an orifice opening 28 and closed at the opposite end forming a base of the orifice 24. As shown, the inner surface 27 of the body 21 forms the base of the orifice 24.

In an embodiment, the retaining member 23 is configured to receive and hold, ("hold" means to enclose within bounds, to limit or hold back from movement or to keep in a certain position), at least a portion of a head 31 of a booster holder 30 (see FIG. 3) in at least a semi-fixed position as will be discussed in more detail below. The booster holder 30 is attached to the charge tube 47 of the previous perforating gun assembly 40 (not shown).

According to an aspect, a gap cover 25, which may be configured as an acceleration member or a flyer disc, covers the gap 26. In an embodiment, the gap cover 25 forms a wall of the gap 26. In the embodiment of FIG. 4, the gap cover 25 is formed as an integrated component with the body 21. By "integrated" what is meant is that the body 21 is made whole by bringing all the parts together or unifying the parts and possibly omitting the gap 26. As contemplated herein, the gap cover 25 can be formed as part of the body, or could be configured as a complementarily-sized (to cover the gap 26) removable portion, which is seated or otherwise positioned above the gap 26 in a way that the gap cover 25 is received in a groove formed in the body 21 such that the surface of the gap cover 25 facing the orifice 24 is flush or seamless with the inner surface 27 of the deformable member 20. (See for instance FIG. 3.) In an embodiment, the gap cover 25 is made from a different material than the body 21 of the deformable member 20.

Figure 5:
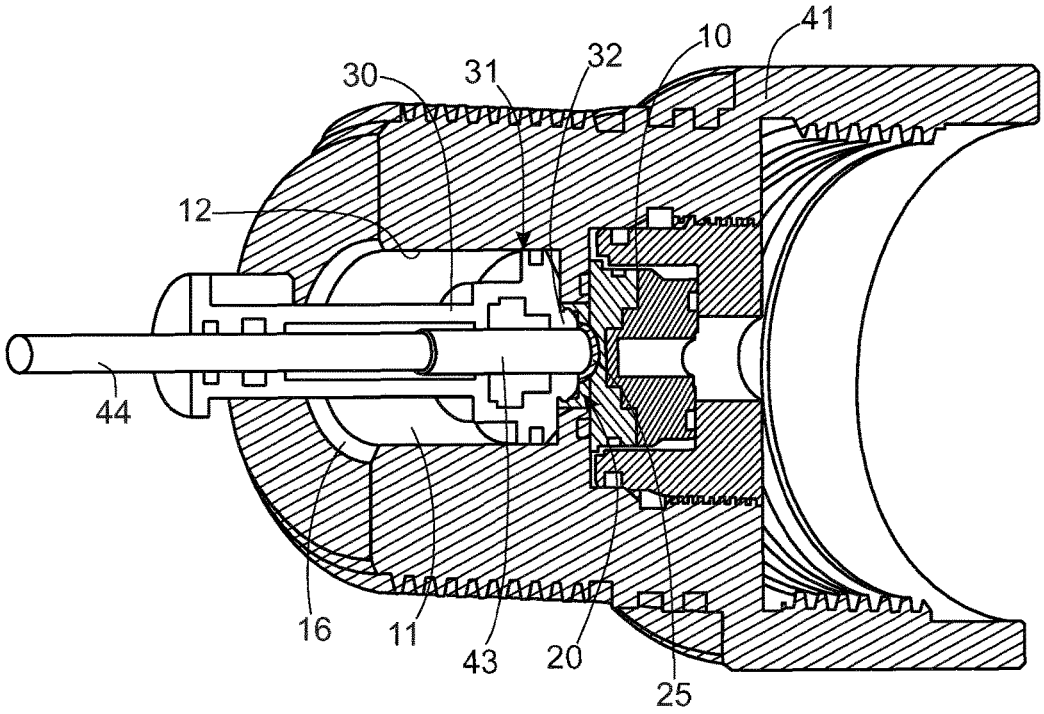
FIG. 5 is a perspective view of the ballistic transfer module and assembly according to an aspect.

Now referring to FIGS. 3 and 5, the firing head 41 useful as part of the assembly of the perforating gun assembly 40 according to an embodiment is provided. The percussion initiator 10 is positioned within the firing head 41, preferably positioned centrally. Such percussion initiators are commercially available; including those sold by DYNAenergetics GmbH & Co., KG, under the brand DYNAWELL®. One end of the percussion initiator 10 is depicted in abutting contact with the deformable member 20. As shown in this embodiment, the deformable member 20 includes a removable gap cover 25 covering the gap 26.

According to an embodiment, the booster holder 30 is provided in abutting contact with the inner surface 27 of the deformable member 20. The booster holder 30 includes a housing member 33 and a head 31 extending from one end of the housing member 33. The housing member 33 includes a housing member bore 34, within which is positioned a detonating cord 44, which connects to a booster 43. As shown herein, booster holder 30 may include cut-away portions that result in a reduction in materials (and thus cost to manufacture), and also provides room for expansion by the booster 43 and the detonating cord 44 upon initiation (as discussed in more detail below).

In an embodiment, the deformable member 20 is configured for assembly in contact with the at least a portion of the head 31 of the booster holder 30.

The firing head 41, in an embodiment, includes a firing head bore 11 including a first wall 12, the bore 11 extending along the length of the firing head 41, and the bore having varying diameters. The first wall 12 opens at a first opening 16 for receiving the booster holder 30, and terminates at a ledge 14 for positioning and abutment of at least a portion of the head 31. In an embodiment, the first wall 12 is thus sized and shaped for receiving at least the head 31 of the booster holder 30 such that when the booster holder 30 is positioned within the bore 11, a portion of the head 31 abuts the ledge 14, while a portion of the head 31 extends beyond the ledge into a portion of the bore defined by a second wall 13. The second wall 13 terminates at the ledge 14 on one end and a second opening 15 at the other end.

In an embodiment, the outer surface 29 of the deformable member 20 is configured for abutment with the percussion initiator 10 and the inner surface 27 of the deformable member 20 is configured for abutment with the booster holder 30. In an embodiment (not shown), the head 31 of the booster holder 30 simply abuts the body 21 of the deformable member 20, and is held in place through retaining means such as but not limited to glue, fasteners and the like. In any case, the components are situated so that the booster 43 abuts the deformable member 20.

In an embodiment, a positioning member 32 extends from the head 31 of the housing member 33, and is configured for entering the collar orifice through the orifice opening 28 and being at least partially seatingly engaged within the collar orifice 24 of the deformable member 20. Thus, the retaining member 23 of the deformable member 20 functions to hold the positioning member 32 in place. In an embodiment, the positioning member 32 is held in at least a semi-fixed position, meaning at least that the positioning member 32 is at least partially fixed, set or otherwise immobilized, in contacting relationship with the deforming member 20. In a preferred embodiment, the retaining member 23 is configured as an annular lip that protrudes from the flange 22. The annular lip is complementarily sized and shaped for receiving at least a portion (preferably a protruding portion) of the positioning member 32, and functions to lock the positioning member 32 into place, or at least hold the positioning member 32 in a semi-fixed position.

As described hereinabove, the ballistic transfer module 50, according to an aspect, includes at least the following components: the deformable member 20, the booster holder 30, the booster 43 and the detonating cord 44, each of the components capable of being assembled in any variation of the embodiments disclosed herein.

At least an embodiment also provides a method for initiating one or more percussion initiators of the perforating gun assembly 40 by assembling the ballistic transfer module 50 as described above and using the deformable member 20 in place of the firing pin 2.

Thus, at least one portion of the perforating gun assembly 40 is assembled as the ballistic transfer module 50, including the deformable member 20, the booster holder 30, the booster 43 and the detonating cord 44, in the various embodiments as discussed in detail above.

In use, the detonating cord 44 is initiated, which in turn activates the booster 43, causing the booster 43 to explode. Explosion of the booster causes the deformable member 20 to deform, which in turn ignites the percussion initiator 10 to fire the perforating gun assembly 40. In an embodiment, a time delay mechanism (not shown) is placed between the booster transfer module 50 and the perforating gun assembly 40 for time-delay initiation.

The components and methods illustrated are not limited to the specific embodiments described herein, but rather, features illustrated or described as part of one embodiment can be used on or in conjunction with other embodiments to yield yet a further embodiment. It is intended that all such modifications and variations are included. Further, steps described in the method may be utilized independently and separately from other steps described herein.

While the device and method have been described with reference to the specific embodiments described herein, it will be understood by those skilled in the art that various changes may be made and equivalents may be substituted for elements thereof without departing from the intended scope. In addition, many modifications may be made to adapt a particular situation or material to the teachings found herein without departing from the essential scope thereof.

In this specification and the claims that follow, reference will be made to a number of terms that have the following meanings. The singular forms "a," "an" and "the" include plural referents unless the context clearly dictates otherwise. Furthermore, references to "one embodiment," "an embodiment," and the like are not intended to be interpreted as excluding the existence of additional embodiments that also incorporate the recited features. Terms such as "first," "second," "above", "below", etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of."

Advances in science and technology may make equivalents and substitutions possible that are not now contemplated by reason of the imprecision of language; these variations should be covered by the appended claims. This written description uses examples to disclose the device and method, including the best mode, and also to enable any person of ordinary skill in the art to practice the device and method, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A ballistic transfer module, comprising:

a deformable member comprising a body, wherein a gap is positioned within the body;

a booster holder comprising a housing member and a head extending from one end of the housing member;

a booster positioned within a bore of the housing member of the booster holder; and a detonating cord extending from the booster, wherein the deformable member is configured for assembly in contact with at least a portion of the head of the booster holder.

2. The ballistic transfer module of claim 1, wherein the body of the deformable member comprises a gap cover, the gap cover provided to form a wall of the gap.

3. The ballistic transfer module of claim 2, wherein the gap cover is formed as an integrated component with the body.

4. The ballistic transfer module of claim 2, wherein the gap cover is made from a different material than the body of the deformable member.

5. The ballistic transfer module of claim 1, wherein the deformable member comprises an inner surface and an outer surface, and wherein the outer surface of the deformable member is configured for abutment with a percussion initiator and the inner surface of the deformable member is configured for abutment with the booster.

6. The ballistic transfer module of claim 5, further comprising:

a collar extending from the body of the deformable member; and a retaining member extending from the collar; and a positioning member extending from the head of the booster, wherein the retaining member is configured for holding the positioning member of the booster holder in at least a semi-fixed position.

7. The ballistic transfer module of claim 6, wherein the retaining member comprises an annular lip complementarily sized and shaped for receiving the positioning member of the booster holder such that the booster abuts the deformable member.

8. The ballistic transfer module of claim 1, wherein the deformable member deforms to initiate the percussion initiator.

9. A ballistic transfer module, comprising:

a deformable member comprising a body, wherein a gap is positioned within the body;

a booster holder comprising a housing member and a head extending from one end of the housing member;

a booster positioned within a bore of the housing member of the booster holder; and a detonating cord extending from the booster, wherein the deformable member is configured for assembly in contact with at least a portion of the head of the booster holder, wherein the gap is centrally positioned in the body of the deformable member at a depth of about 0.4 mm to about 0.6 mm below an inner surface of the deformable member, the gap is bound by walls forming a cylindrically-shaped opening, the gap having a depth of about 0.4 mm to about 0.6 mm, and a radius of about 3 mm to about 7 mm.

10. The ballistic transfer module of claim 9, wherein the body of the deformable member comprises a gap cover, the gap cover provided to form a wall of the gap.

11. The ballistic transfer module of claim 10, wherein the gap cover is formed as an integrated component with the body.

12. The ballistic transfer module of claim 10, wherein the gap cover is made from a different material than the body of the deformable member.

13. The ballistic transfer module of claim 9, wherein the deformable member comprises an inner surface and an outer surface, and wherein the outer surface of the deformable member is configured for abutment with a percussion initiator and the inner surface of the deformable member is configured for abutment with the booster.

14. The ballistic transfer module of claim 13, further comprising:

a collar extending from the body of the deformable member; and a retaining member extending from the collar; and a positioning member extending from the head of the booster, wherein the retaining member is configured for holding the positioning member of the booster holder in at least a semi-fixed position.

15. The ballistic transfer module of claim 14, wherein the retaining member comprises an annular lip complementarily sized and shaped for receiving the positioning member of the booster holder such that the booster abuts the deformable member.

16. The ballistic transfer module of claim 9, wherein the deformable member deforms to initiate the percussion initiator.

* * * * *